US005926898A

United States Patent [19]

Kramer

[11] Patent Number: 5,926,898

[45] Date of Patent: Jul. 27, 1999

[54] TOOTHBRUSH

[75] Inventor: Hans Kramer, Buhl (Baden), Germany

[73] Assignee: SmithKline Beecham Consumer Healthcare GmbH, Buhl, Germany

[21] Appl. No.: 08/894,480

[22] PCT Filed: Feb. 20, 1996

[86] PCT No.: PCT/EP96/00714

§ 371 Date: Jan. 30, 1998

§ 102(e) Date: Jan. 30, 1998

[87] PCT Pub. No.: WO96/25866

PCT Pub. Date: Aug. 29, 1996

[30] Foreign Application Priority Data

Feb. 24, 1995 [GB] United Kingdom ..... 9503706

[51] Int. Cl.[6] ..... A46B 9/04

[52] U.S. Cl. ..... 15/167.1; 15/DIG. 5

[58] Field of Search ..... 15/DIG. 5, 167.1

[56] References Cited

U.S. PATENT DOCUMENTS

| | | | |
|---|---|---|---|
| 3,188,672 | 6/1965 | Gary | 15/167.1 |
| 3,792,504 | 2/1974 | Smith | 15/167.1 |
| 4,852,202 | 8/1989 | Ledwitz . | |
| 5,325,560 | 7/1994 | Pavone et al. . | |

FOREIGN PATENT DOCUMENTS 0 471 312 A2 2/1992 European Pat. Off. .

*Primary Examiner*—Randall E. Chin
*Attorney, Agent, or Firm*—Nora Stein-Fernandez; Janice E. Williams; Charles M. Kinzig

[57] ABSTRACT

A toothbrush wherein the stiffness of the bristles varies along the length or across the width of the head of the toothbrush.

15 Claims, 2 Drawing Sheets

TOOTHBRUSH

FIELD OF THE INVENTION

This invention relates to toothbrushes, in particular to toothbrushes where the stiffness of the bristles varies along the length or across the width of the head of the toothbrush.

BACKGROUND OF THE INVENTION

Generally a toothbrush has a head and a handle disposed along a longitudinal axis, the head having bristles arranged in tufts extending from a face thereof ("the bristle face") in a general bristle direction. It is known, e.g. in British Standards Institution publication BS 5757:1979 "Specification for Toothbrushes" that the stiffness of a toothbrush bristle is related to its length and diameter. For bristles of the same diameter and material, longer bristles will be less stiff than shorter bristles.

Generally the bristle face is planar. Toothbrushes are disclosed in GB 501124 and GB 1098933 in which the ends of the bristles remote from the bristle face (the "remote ends") generally lie in a non-planar surface, those of GB 501124 lying in a stepped surface, those of GB 1098933 lying in an undulating surface. To maintain a uniform stiffness of the bristles of these latter toothbrushes, the bristle face is displaced from planarity in the general bristle direction in a manner which corresponds substantially to the surface in which the ends of the bristles lie. In U.S. Pat. No. 4,010,509 a toothbrush with parts of its bristle face displaced from planarity is disclosed, again to cause the bristle ends to lie in a corresponding non-planar surface. U.S. Pat. No. 4,776,054 discloses a toothbrush in which parts of the bristle face are displaced from planarity in the general bristle direction, but in which the bristles are all of substantially the same length, the displaced parts being used to impart a tilt to the tufts. EP 0175084A, U.S. Pat. No. 4,010,509 and U.S. Pat. No. 5,325,560 disclose toothbrushes in which the bristle face has an undulating profile widthways. U.S. Pat. No. 4,852,202 discloses a toothbrush with a raised "working platform" from which extend short sloping bristles. JP 04-122306A discloses a toothbrush with a longitudinally aligned ridge with a corresponding bristle profile. EP 0471312 A discloses a toothbrush in which the bristle surface is in a stepwise shape, with longer bristles on the lower steps.

It can be desirable to vary the stiffness of the bristles of toothbrushes along the length of the head of the toothbrush, for example so that the toothbrush may have stiff bristles to clean in the interdental spaces, and softer bristles to clean the broad areas of the teeth, or vice versa. This variation in stiffness can be achieved by the use of different bristle fibre materials, diameters, packing density etc. but such approaches can lead to manufacturing complexities.

The object of the present invention is to provide a relatively simple construction of toothbrush which enables the stiffness of the bristles to be varied along the length or across the width of the head of the toothbrush.

SUMMARY OF THE INVENTION

According to this invention, a toothbrush has a head and a handle disposed along a longitudinal axis, the head having bristles extending from a bristle face in a general bristle direction substantially perpendicular to the longitudinal axis, the bristle face having a surface that varies in its displacement distance in the general bristle direction, from a plane ("the longitudinal plane") passing through the head parallel to its longitudinal axis and perpendicular to the general bristle direction, with distance along the length of the head characterised in that:

there are at least two more displaced ("high") parts with at least one less displaced ("low") part longitudinally in between, and longer bristles extend from the less displaced parts of the bristle face and shorter bristles extend from more displaced parts of the bristle face, so that the length the bristles extend from the bristle face, and as a consequence the stiffness of the bristles, varies with distance along the length of the head.

DETAILED DESCRIPTION OF THE INVENTION

By means of the toothbrush of the invention some bristles are shorter than others, and as a consequence are more stiff than the longer bristles. By suitable relative positioning of these shorter and longer, i.e. more stiff and less stiff, bristles, more stiff bristles may be provided at places on the head which are convenient for cleaning the broad areas of the teeth, whilst less stiff bristles may be in places on the head which are convenient to clean the interdental spaces, or vice versa. For example the stiffness of the bristles may vary with distance along the length of the head to achieve this, so as to position more stiff and less stiff bristles at distances along the head related to the spacing between the interdental areas. For example parts from which longer bristles extend may be spaced apart by distances corresponding to the typical width of the broad areas of the teeth.

The bristle face may undulate and be displaced in the general bristle direction in various ways. For example the bristle face may rise to one or more high parts, e.g. a widthways aligned ridge, a barrel-vaulted surface, i.e. a rounded arched surface e.g. with a semi-cylindrical arched surface, with its ridge aligned widthways, or a domed or pyramidal surface etc., with the surface descending away longitudinally to low parts on either side of the high part.

In another way the bristle face may rise to high parts at either end of the head, with the surface descending longitudinally or widthways e.g. in a sloping planar or curved shape, to a dip in between the high parts.

In another way the bristle face may have a longitudinally undulating, e.g. zigzag or other wave-form profile of two or more alternating high parts, and troughs arranged widthways across the head, with either a high part, or a low part at each end of the head. The descent from the high parts, or the ascent up from the low parts may be by a planar or curved slope, or stepwise. Alternative constructions will be apparent to those skilled in the art.

Preferably the variation in displacement of the bristle face with the longitudinal distance forms a longitudinally undulating shape. Only the bristle face need be displaced, although the entire head of the toothbrush, including the opposite face may be displaced in the general bristle direction in a manner corresponding to the bristle face.

When the bristle face varies gradually, i.e. slopes or with a series of small steps, between the high and low parts, there may be bristles of intermediate length and stiffness located between the most displaced and least displaced parts. In his way there can be a smooth gradation in stiffness between the more stiff and less stiff bristles.

In one embodiment of the invention the bristle surface may have a substantially flat less displaced part at and near its distal end and at and near its proximal end, and in between two parts more displaced in the general bristle direction each in the form of a ridge with a surface sloping between more and less displaced parts thereof, e.g. of a barrel-vaulted shape with the vault axes across the width of the head, a valley lying between these two ridged parts and across the width of the head, the valley forming a less displaced part. Longer less stiff bristles may extend from the flat parts and the valley, and shorter stiffer bristles may extend from the peaks of the more displaced parts, with bristles of intermediate length on the slopes of the ridge.

The bristle face may also have a surface that varies in its displacement distance in the general bristle direction, from a plane ("the longitudinal plane") passing through the head parallel to its longitudinal axis and perpendicular to the general bristle direction, with distance both along the length of the head such that there are at least two more displaced ("high") parts with at least one less displaced ("low") part longitudinally in between as described above, and also across the width of the head.

Suitably the bristles extend from the bristle face in a direction substantially perpendicular to the bristle face, although some of the bristles within nominally perpendicularly tufts may be inclined at a non-perpendicular angle to the bristle face, for example as a result of inevitable splay, or wear.

In one embodiment groups or tufts of the bristles of the toothbrush of the invention may vary in an alternating manner in length and hence stiffness along the length of the head of the toothbrush. For example there may be long, hence less stiff, distal bristles at and near the distal end of the head furthest from the handle, long hence less stiff, proximal bristles at and near the proximal end of the head nearest to the handle, long hence less stiff, intermediate bristles at and near the longitudinal mid point of the head between the distal and proximal ends of the head, with shorter hence more stiff, bristles between the distal and intermediate bristles, and between the proximal and intermediate bristles, the long less stiff bristles extending from low parts of the bristle face, and the shorter more stiff bristles extending from high parts of the bristle face.

If the variation in length between the said longer and shorter bristles corresponds directly inversely to the variation in displacement distance between the low and high parts of the bristle face from which the bristles extend, the remote ends of the bristles may lie in substantially a plane parallel to the longitudinal plane. Alternatively the variation in length of the bristles may vary with no relationship, or in some other relationship to the displacement distance, so that the ends of the bristles remote from the bristle face may lie in an undulating surface, which does not correspond to the surface shape, e.g. undulations, of the bristle face.

If for example the variation in length between the said longer and shorter bristles is greater than the variation in displacement distance between the less and more displaced parts of the bristle face from which the bristles extend, then the remote ends may lie in a surface having concavities corresponding to the positions of the more displaced parts. Such concavities may be shaped to correspond to a generalised shape of a tooth surface.

The bristles may be arranged in a pattern upon the bristle face of the toothbrush in ways which are generally conventional, for example in a pattern of discrete tufts, which may be generally of circular cross section perpendicular to the general bristle direction, or alternatively in mats of non circular section perpendicular to the general bristle direction, for example of elongated section, e.g. oval, lozenge shaped or rectangular with rounded ends, or linear. For example such elongated mats may be elongated along the length or across the width of the surface of the bristle face. The toothbrush may have combinations of differently sectioned tufts located at different locations on the bristle face, for example one type at high points or areas and another at low points or areas. In this way elongated tufts can vary in stiffness along or across the axes of their cross section.

It is particularly preferred to have a pattern of discrete tufts arranged in a generally circular or polygonal pattern, or a single tuft of generally rounded cross section perpendicular to the bristle face at the distal end of the bristle pattern on the bristle face.

The bristles may for example be arranged on the toothbrush head in the patterns disclosed in PCT/EP 94/02828, the contents of which are included herein by way of reference, and which discloses a toothbrush in which the bristles on the head are all arranged in a pattern of a plurality of discrete tufts projecting from the bristle face of the toothbrush head, one or more of the tufts ("first tufts") having a cross section perpendicular to the tuft axis which has a greater dimension in the direction generally parallel to the toothbrush axis than in the direction generally perpendicular to the toothbrush axis, in combination with one or more tufts ("second tufts") at the end of the tuft pattern remote from the handle being in the form of either (i) a pattern of discrete tufts arranged in a generally circular or polygonal pattern, or (ii) a single tuft of generally rounded cross section perpendicular to the bristle face, or (iii) a tuft of generally "C" or "U" shaped cross section perpendicular to the bristle face having at least one of the limbs of the "C" or "U" aligned generally parallel to the longitudinal toothbrush axis and with the rounded bend of the "C" or "U" facing the end of the bristle face remote from the handle. In the toothbrush of the invention the first tufts may be located on more displaced parts of the bristle face. First and second tufts may be combined with other tufts ("third tufts") of other cross sections.

In one embodiment of the invention therefore, the toothbrush comprises the following sequence of tufts, starting from the distal end of the head: (i) a pattern of discrete second tufts arranged in a generally circular or polygonal pattern, optionally around a central tuft, on a distal low part. (ii) one or more rows, suitably one row, of third tufts arranged across the toothbrush head, and these third tufts may have a cross section which is elongated across the toothbrush head, on the distal low part. (iii) one or more rows, suitably two, three or four rows, of first tufts having a cross section perpendicular to the tuft axis which has a greater dimension in the direction generally parallel to the longitudinal axis than in the direction generally perpendicular to the longitudinal axis, these first tufts being located on a first high part of the bristle face. (iv) in a valley between the first high part and a second high part on the proximal side of the valley one or more rows, suitably one row, of third tufts arranged across the toothbrush head, and these third tufts may have a cross section which is elongated across the toothbrush head. (v) one or more rows, suitably two, three or four rows, of first tufts having a cross section perpendicular to the tuft axis which has a greater dimension in the direction generally parallel to the longitudinal axis than in the direction generally perpendicular to the toothbrush axis, these first tufts being located on the second high part of the bristle face. (vi) at a low part at the proximal end of the bristle pattern one or more rows, suitably one row, of third tufts arranged across the toothbrush head, and these third tufts may have a cross section which is elongated across the toothbrush head.

Such tufts and/or mats may be fastened into the toothbrush head in conventional ways, for example with conventional small metal clips. Preferably the tufts and/or mats are welded into the toothbrush head, as machines used to implant bristles into toothbrush heads with metal clips can suffer problems with a nonplanar bristle face. Welding may be achieved using known welding techniques, such as moulding the head of the toothbrush around the ends of the tufts or mats to be fastened into the head. Methods of welding in the tufts and/or mats are for example disclosed in DE 44 15 886A, EP 0326634A, EP 0346646A and EP 0197384A amongst other publications.

The toothbrush of the invention may include other known features of toothbrushes such as the 'V' shaped folds of EP 0336641A or the flexible link between the head and the neck of WO 92/17092, which help to control the flexibility of the toothbrush.

The entire toothbrush may be made out of materials conventional in the art of toothbrushes, e.g. plastics materials, and may be made by conventional plastics moulding techniques. The invention also provides a process for making a toothbrush as described above.

The invention will now be described by way of example only with reference to the following drawings.

DETAILED DESCRIPTION OF THE DRAWINGS

Figure 1:
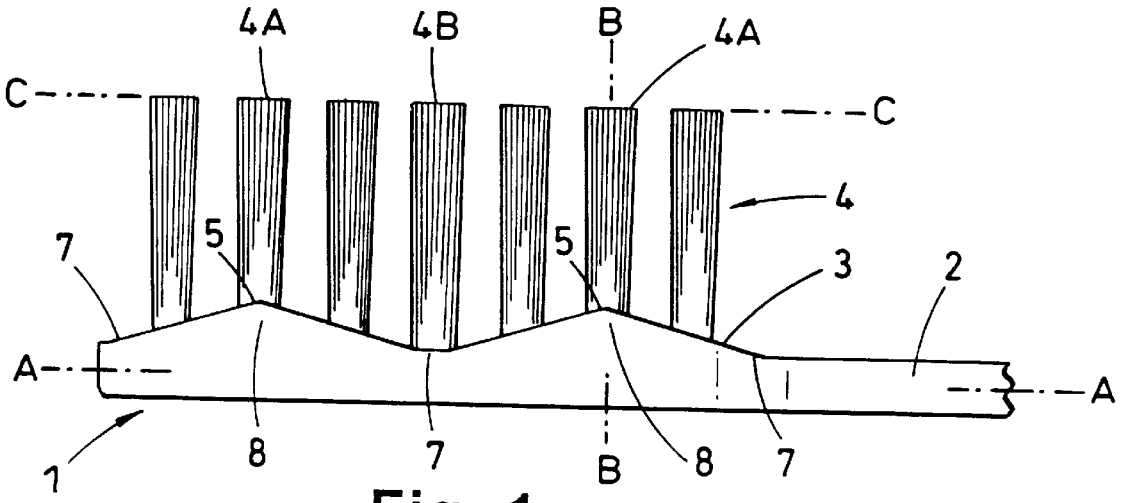
FIGS. 1 and 2 show sideways views of toothbrushes of this invention.

Referring to FIGS. 1–5, a toothbrush has a head 1 and a handle 2 disposed along a longitudinal axis A—A. The handle 2 continues to form a conventional grip region (not shown). From a bristle face 3 of the head 1 extend bristles 4 (generally) in a general bristle direction B—B substantially perpendicular to the longitudinal axis A—A.

The bristle face 3 has a surface that varies in its displacement distance from a plane ("the longitudinal plane"), passing through the head 1 parallel to its longitudinal axis A—A and perpendicular to the general bristle direction B—B, in the general bristle direction B—B with distance along the length of the head 1. The length of the bristles 4 also varies at different positions on the bristle face 3 such that shorter bristles 4A, 4C extend from more displaced ("high") parts 5, 6 of the bristle face 3 and longer bristles 4B, 4E extend from less displaced ("low") parts 7 of the bristle face 3, so that the length the bristles 4 extend from the bristle face 3, and as a consequence the stiffness of the bristles 4, varies with distance along the length of the head 1.

Figure 2:
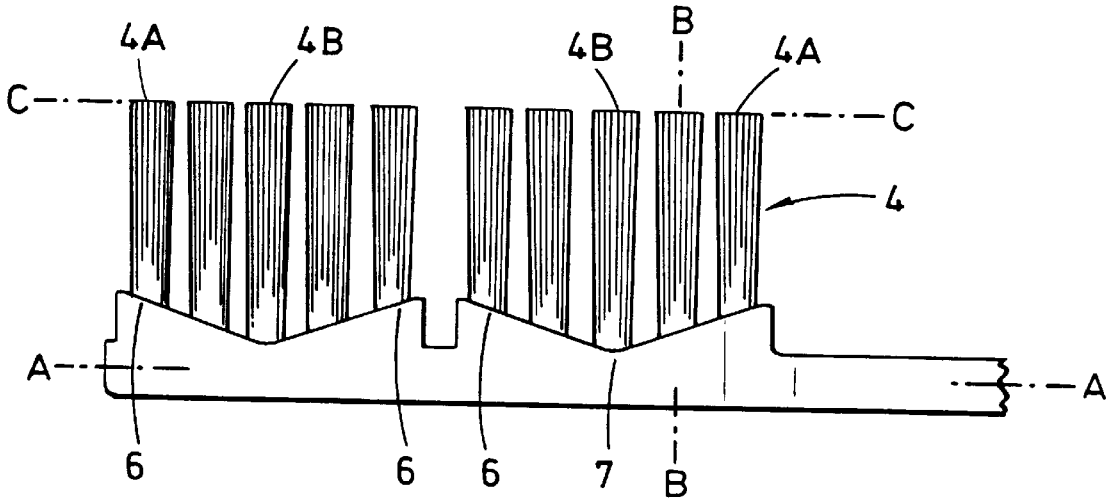
Figure 3:
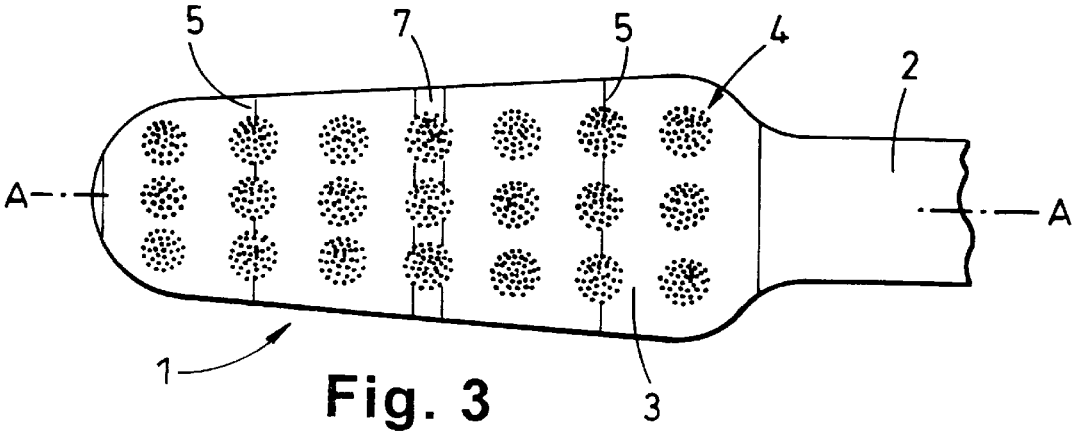
FIG. 3. shows a plan view of the head and immediately adjacent handle region of the toothbrush of FIG. 1.

In the toothbrush of FIGS. 1, 2 and 3, the bristle face 3 is an undulating surface displaced in the general bristle direction B—B into alternating more displaced high parts 5, 6 and less displaced low parts 7. The bristles 4A which extend from more displaced parts 5, 6 of the bristle face 3 are shorter, and consequently stiffer, than bristles 4B which extend from less displaced parts 7 of the bristle face 3. As the difference in length between short bristles 4A and long bristles 4B corresponds inversely to the distance to which the bristle face 3 is displaced in the general bristle direction B—B, the ends of the bristles 4 remote from the surface 3 lie substantially in a flat plane C—C.

In the toothbrush of FIG. 1 the bristle face 3 has a low part 7 at each end and about the longitudinal middle, and two high parts 5 between the low parts 7. The bristle face 3 is an undulating surface defined by two laterally aligned ridges 8, having its high parts 5 on the peaks of the ridges 8, and a low part 7 at the valley between the ridges 8.

In the toothbrush of FIG. 2 the bristle face 3 undulates in the form of two V-profiled surfaces having a high part 6 at each end and high parts 6 about the longitudinal middle, and low parts 7 between the high parts 6.

In FIG. 3, the plan view of the toothbrush of FIG. 1 is shown, the bristles 4 are shown to be arranged in circular sectioned tufts.

Figure 4:
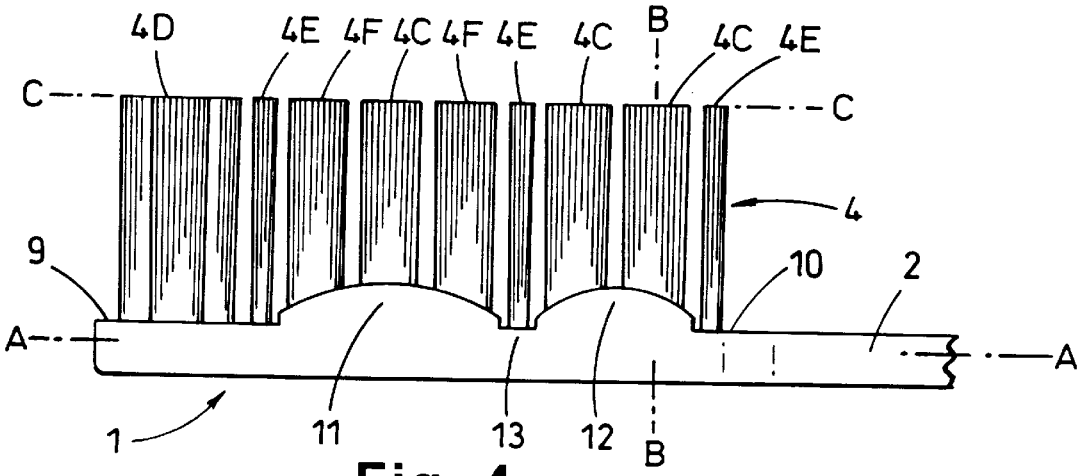
FIG. 4. shows a side view of the head and immediately adjacent handle region of a further toothbrush of this invention.
Figure 5:
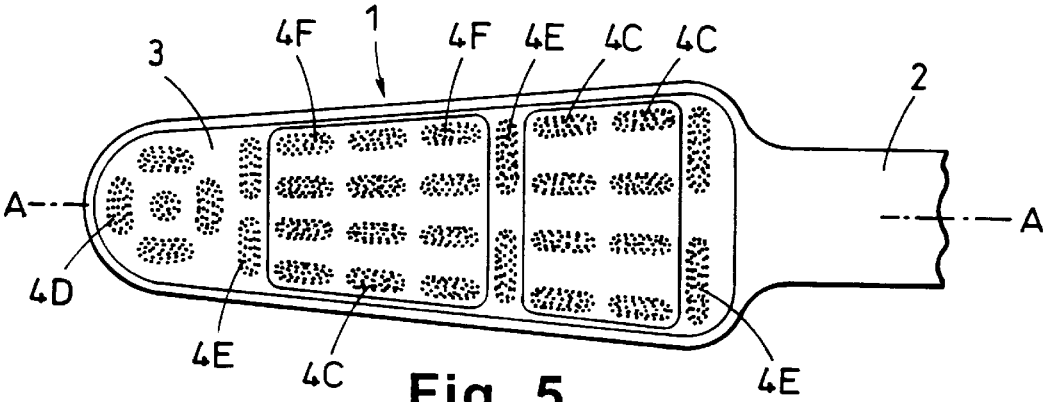
FIG. 5. shows a plan view of the head and immediately adjacent handle region of the toothbrush of FIG. 4.

In the toothbrushes of FIGS. 4 and 5, parts corresponding to those of FIGS. 1 to 3 are numbered correspondingly. The bristle surface 3 has a substantially flat less displaced part 9 at and near its distal end and another 10 at and near its proximal end. Between these there are two parts 11, 12 displaced in the general bristle direction B—B in the form of a ridge with a surface sloping between more and less displaced parts, e.g. of a barrel-vaulted shape with the vault axes across the width of the head. A valley 13 lies between these two vaulted parts 11, 12 and across the width of the head, and forms a less displaced part. Longer less stiff bristles 4D, 4E extend from the flat parts 9, 10 and the valley 13, and shorter stiffer bristles 4C extend from the peaks of the more displaced parts 11, 12, with bristles 4F of intermediate length on the slopes of the ridge.

In the toothbrush of FIGS. 4 and 5, the bristles on the head 1 are all arranged in a pattern of a plurality of discrete tufts 4 (generally) projecting from the bristle face 3 of the toothbrush head 1, tufts 4C, extending from the high points 5 on the tops and slopes of the barrel vaults 9, having a cross section perpendicular to the general bristle direction B-B which has a greater dimension in the direction generally parallel to the toothbrush axis A—A than in the direction generally perpendicular to the toothbrush axis A—A. Longer tufts 4D at the end of the tuft pattern remote from the handle 2 are in the form of a pattern of discrete tufts arranged in a generally circular or polygonal pattern. In the low points 9 are long tufts 4E which are of elongated section having their section elongated across the width of the toothbrush. As the longitudinally elongated tufts 4C are mounted on regions of the barrel vaults 9 which slope away from the high point 5, bristles in the parts of the tufts 4C nearer the high point 5 of the, barrel-vaulted surface 9 are shorter than those in parts which are nearer the lower parts of the barrel vaulted surface.

The toothbrush of FIGS. 4 and 5 therefore comprises the following sequence of tufts, starting from the distal end of the head: (i) a pattern of discrete second tufts 4D arranged in a generally circular or polygonal pattern around a central tuft, at a distal low part. (ii) one row of third tufts 4E arranged across the toothbrush head, with a cross section which is elongated across the toothbrush head, in the distal low part. (iii) three rows of first tufts 4C, 4F having a cross section perpendicular to the tuft axis which has a greater dimension in the direction generally parallel to the longitudinal axis A—A than in the direction generally perpendicular to the toothbrush axis, these first tufts 4C, 4E being located on a first high part 11 of the bristle face. (iv) in the valley 13 between the first high part 11 and the second high part 12 on the proximal side of the valley 13 one row of third tufts 4E arranged across the toothbrush head, these third tufts having a cross section which is elongated across the toothbrush head. (v) two rows of first tufts 4C, 4F having a cross section perpendicular to the tuft axis which has a greater dimension in the direction generally parallel to the longitudinal axis than in the direction generally perpendicular to the longitudinal axis, these first tufts being located on the second high part 12 of the bristle face 3. (vi) at a low part at the proximal end of the bristle pattern, one row of third tufts 4E arranged across the toothbrush head 1 these third tufts 4E having a cross section which is elongated across the toothbrush head 1.

The bristles 4C which extend from more displaced regions of the bristle face 3, i.e. the high points 11, 12 are shorter, and consequently stiffer, than longer bristles 4 in tufts 4D, 4E, which extend from less displaced regions 9, 10, 13 of the bristle face 3. As the difference in length between short bristles 4C and long bristles 4D, 4E corresponds inversely to the distance to which the bristle face 3 is displaced in the barrel vaults 9, in the general bristle direction B—B, the ends of the bristles 4 remote from the surface 3 lie substantially in a flat plane C—C.

The shorter bristles e.g. 4A, 4C are consequently stiffer than the longer tufts 4B, 4D, 4E. Shorter stiffer bristles 4 are effective for cleaning the broad surfaces of the teeth, and the longer softer bristles 4B, 4D, 4E are effective for cleaning the interdental spaces of the teeth. The high point 5 to high point 5 distance in the toothbrushes may correspond approximately to the width of the teeth to be brushed with the toothbrush.

Figure 6:
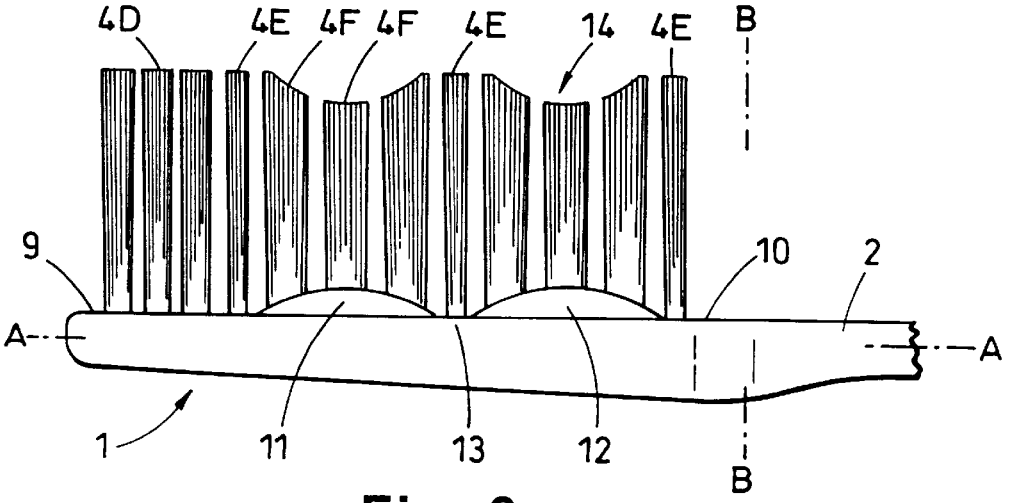
FIG. 6 Shows a side view of the head and immediately adjacent handle region of a further toothbrush of this invention.

Referring to FIG. 6 a toothbrush similar in concept to that of FIGS. 4 and 5 is shown, corresponding parts being numbered correspondingly. The variation in length between the longer 4D, 4E and shorter 4C bristles is greater than the variation in displacement distance between the less 9, 10, 13 and more 11, 12 displaced parts of the bristle face 3 from which the bristles extend. The remote ends of the bristles 4 therefore lie in a surface having concavities 14 corresponding to the positions of the more displaced parts 11, 12. Such concavities 14 may be shaped to correspond to a generalised shape of a tooth surface, such that the longer bristles 4E are guided toward the interdental spaces during use.

The tufts of bristles 4 may be fixed into the bristle face 3 by conventional means, e.g. small metal clips around the fixed end, which are then compression fitted into corresponding sockets in the face 3, or else they may be fused with the material of the head 1. Fusion with the material of the head 1 is particularly suitable for the tufts 4C, 4E and 4F of elongated section.

I claim:

1. A toothbrush being of an elongate shape along a longitudinal axis, which has a head and a handle disposed along the longitudinal axis, the head having a face, bristles arranged in a pattern extending from the face in a general bristle length direction substantially perpendicular to the longitudinal axis, the toothbrush having a width direction generally perpendicular to both the longitudinal axis direction and the general bristle direction, the face having a surface that varies with distance in the longitudinal direction, in its displacement in the general bristle direction, from a plane projected through the head parallel to its longitudinal axis and perpendicular to the general bristle direction, wherein the face has at least two parts which are more displaced from the plane with at least one part which is less displaced from the plane longitudinally in between any pair of two of the more displaced parts, wherein longer bristles extend from the at least one less displaced part of the face and shorter bristles extend from the at least two more displaced part of the face, so that the length of the bristles extend from the face, and as a consequence the stiffness of the bristles, varies with distance in the longitudinal axis direction along the length of the head.

2. A toothbrush according to claim 1 wherein the bristle face has a longitudinally undulating profile with one of said more displaced parts at each end of the head.

3. A toothbrush according to claim 1 wherein the face has a first substantially flat part which is less displaced from the plane located at and near its end distal from the handle and a second substantially flat part which is less displaced from the plane located at its end proximal to the handle, and in between these first and second less displaced parts there are located said two parts more displaced from the plane, each of the two more displaced parts being in the form of a ridge, each ridge rising to a peak at its most displaced part having a surface sloping between more and less displaced parts thereof, a valley lying between these two ridges and across the width of the head.

4. A toothbrush according to claim 3 wherein longer less stiff bristles extend from the flat parts and the valley, and shorter stiffer bristles extend from the peaks of the more displaced parts, with bristles of length intermediate between that of the longer and shorter bristles extending from the slopes of the ridge.

5. A toothbrush according to claim 1 having tufts of bristles which are relatively longer and less stiff alternating along the longitudinal axis direction of the toothbrush with relatively shorter and more stiff tufts of bristles.

6. A toothbrush according to claim 1 having long relatively less stiff first bristles at the longitudinally distal end of the head furthest from the handle, long relatively less stiff second bristles at the end of the head proximal to the handle, long relatively less stiff third bristles at and near the longitudinal mid point of the head between the ends of the head which are distal and proximal to the handle, with shorter relatively more stiff bristles located between the first and third bristles, and between the second and third bristles, the long relatively less stiff bristles extending from the parts of the face which are less displaced from the plane, and the shorter relatively more stiff bristles extending from the parts of the bristle face which are more displaced from the plane.

7. A toothbrush according to claim 1 wherein the difference in length between the longer and shorter bristles corresponds directly inversely to the difference in displacement from the plane between the parts of the face which are more displaced and which are less displaced such that the remote ends of the bristles lie substantially in a plane parallel to the longitudinal plane.

8. A toothbrush according to claim 1 wherein the difference in length between the longer and shorter bristles is greater than the variation in displacement between the less and more displaced parts of the face such that the ends of the bristles which are remote from the face lie in a surface having concavities corresponding to the positions of the more displaced parts.

9. A toothbrush according to claim 1 wherein the bristles are arranged in mats which are of non circular section cut perpendicular to the general bristle direction.

10. A toothbrush according to claim 9 having combinations of differently sectioned tufts located at different locations on the face.

11. A toothbrush according to claim 9 wherein the following sequence of tufts, starting from the end of the head distal from the handle and proceeding in the longitudinal direction toward the end of the head proximal to the handle:

(i) a relatively less displaced first part of the face which is at the end of the bristle pattern distal from the handle having extending therefrom a pattern of discrete tufts arranged in a generally circular or polygonal pattern;

(ii) at least one row of tufts arranged across the width of the toothbrush head having a cross section cut across the bristle direction which is elongated across the width of the toothbrush head, extending from the first part of the head;

(iii) a relatively more displaced second part of the face having extending therefrom at least one row of tufts having a cross section cut perpendicular to the general bristle direction which has a greater dimension in the direction generally parallel to the longitudinal axis than in the direction generally perpendicular to the longitudinal axis;

(iv) a relatively less displaced third part having extending therefrom at least one row of tufts arranged across the toothbrush head having a cross section cut perpendicular to the general bristle direction which is elongated across the width of the toothbrush head;

(v) a relatively more displaced fourth part having extending therefom at least one row of tufts having a cross section cut perpendicular to the general bristle direction which has a greater dimension in the direction generally parallel to the longitudinal axis than in the direction generally perpendicular to the toothbrush axis;

(vi) a relatively less displaced fifth part at the end of the bristle pattern proximal to the handle having extending therefrom at least one row of tufts arranged across the toothbrush head, these tufts having a cross section cut perpendicular to the general bristle direction which is elongated across the toothbrush head.

12. A toothbrush according to claim 1 having discrete tufts arranged in a generally circular or polygonal pattern cut perpendicular to the bristle face, at the end distal from the handle.

13. A toothbrush according to claim 1 wherein the bristle face has a longitudinally undulating profile of at least two parts which are more displaced from the plane, and at least one trough aligned across the head, the at least one trough being located longitudinally between two of the more displaced parts, with either a high part, or a low part at each end of the head.

14. A toothbrush according to claim 1 having groups of tufts of bristles which are relatively longer and less stiff alternating along the longitudinal direction of the toothbrush with groups of relatively shorter and more stiff tufts of bristles.

15. A toothbrush according to claim 1 having a single tuft of generally rounded cross section cut perpendicular to the bristle face, at the end distal from the handle.

* * * * *